US005732308A

United States Patent [19]

Miura

[11] Patent Number: 5,732,308

[45] Date of Patent: Mar. 24, 1998

[54] EXPOSING APPARATUS HAVING DISCONNECTION DETECTING FUNCTION FOR EXPOSURE LAMP

[75] Inventor: Tatsuyuki Miura, Yokohama, Japan

[73] Assignee: Kabushiki Kaisha Toshiba, Kanagawa-ken, Japan

[21] Appl. No.: 676,466

[22] Filed: Jul. 8, 1996

[30] Foreign Application Priority Data

Jul. 11, 1995 [JP] Japan ..... 7-174799

[51] Int. Cl.[6] ..... G03G 21/00; G03G 15/043

[52] U.S. Cl. ..... 399/32; 399/220

[58] Field of Search ..... 399/32, 31, 220, 399/411

[56] References Cited

U.S. PATENT DOCUMENTS

| | | | |
|---|---|---|---|
| 4,095,890 | 6/1978 | Herten | 399/32 |
| 4,269,500 | 5/1981 | Ito et al. | 399/32 |
| 4,785,328 | 11/1988 | Tanimoto et al. | 399/32 |
| 4,853,739 | 8/1989 | Miyamoto et al. | 399/32 |
| 5,336,976 | 8/1994 | Webb et al. | 399/32 |

FOREIGN PATENT DOCUMENTS

| | | |
|---|---|---|
| 57-164766 | 10/1982 | Japan . |
| 2-109038 | 4/1990 | Japan . |

*Primary Examiner*—R. L. Moses
*Attorney, Agent, or Firm*—Limbach & Limbach, LLP

[57] ABSTRACT

An exposing apparatus having exposing function for irradiating light and scanning an original, function for detecting a reflected light from the original, function for setting the exposing function so as to repeat a plural times of the exposing/scanning same one of the original, function for calculating out a amount of the reflected light every one of the plural times of exposing/scanning when the setting function sets the plural times of exposing/scanning, and function for determining a malfunction of the exposing function by means of referring of the amount.

18 Claims, 10 Drawing Sheets

EXPOSING APPARATUS HAVING DISCONNECTION DETECTING FUNCTION FOR EXPOSURE LAMP

BACKGROUND OF THE INVENTION

1. Field of the Invention

The present invention relates to an image forming apparatus such as an electronic copying machine for detecting the disconnection of, e.g., an exposure lamp and forming an image in an optimal exposure state.

2. Description of the Related Art

In an image forming apparatus such as an electronic copying machine, an original placed on an original glass (original table) is illuminated by an exposure lamp, and light used for exposing and scanning the original and reflected by the original is guided to form a latent image corresponding to the original on a photosensitive drum. Toner is applied to this latent image by a developing unit to visualize the latent image, and the visualized toner image is transferred to a sheet using a transfer unit. The toner image on the sheet is then fixed using a fixing unit, thereby performing image copying.

In this conventional apparatus, the disconnection of the exposure lamp is determined as follows. That is, a reference patch or the like is formed between the home position and the leading end of an original (i.e., under an indicator) in the original scanning operation of a scanner, and light reflected by the reference patch or the like upon exposure with the exposure lamp is detected by a sensor for determining the density (density information) of the original. When the amount of reflected light incident on the sensor is smaller than a predetermined value, a disconnection of the exposure lamp is determined.

The interval for determining (detecting) the disconnection is defined as the distance (i.e., under the indicator) between the home position and the leading end of the original, and this distance is a maximum of several tens of mm and corresponds to less than 50 msec, particularly, in a high-speed copying machine (60 cpm or more per A4 size). The number of data to be sampled is a maximum of about 4 to 5 at 50 Hz even if, e.g., the zero-crossing timings of a power supply are used. Therefore, a sufficient margin against disturbances such as noise cannot be assured.

In the conventional apparatus, since a disconnection is detected under the indicator (between the home position and the leading end of the original) in the original scanning operation of the scanner, the number of data to be sampled (i.e., the time length or physical size) cannot be large particularly in a high-speed copying machine. Therefore, a disconnection of the exposure lamp cannot be reliably detected by disturbances such as electrical noise and external light noise generated upon opening a platen cover.

SUMMARY OF THE INVENTION

It is an object of the present invention to provide an exposing apparatus having improved reliability in exposure lamp disconnection detection.

The present invention is an exposing apparatus comprises: a manuscript table on which an original is placed; exposing means for irradiating light the original placed on the manuscript table and scanning the original; means, arranged in a vicinity of the exposing means, for reflecting the light from the exposing means so as to generate a first reflected light; means for detecting the first reflected light from the reflecting means and a second reflected light from the original; means for setting the exposing means so that the exposing means repeats a plurality of times the exposing/scanning of the original; first means for calculating a first amount of the first reflected light every one of the times of exposing/scanning, when the setting means sets the times of exposing/scanning; second means for calculating a second amount of the second reflected light every one of the times of exposing/scanning, when the setting means sets the times of exposing/scanning; and means for determining the exposing means as trouble by means of referring of the first and second amounts.

With the above structure, for example, to obtain 10 copies from one original, the amount of reflected light beam corresponding to the image density of this original is detected 10 times, and the resultant light amount values are sequentially compared. If a large change occurs in these light amount values, it is determined that the exposure lamp is disconnected.

Since a disconnection of the exposure lamp is detected by the above method, the number of data used for determination is larger than that obtained in conventional disconnection detection using only the reflection patch, thereby realizing more accurate disconnection detection with a larger margin.

In addition, the present invention also uses reflected light from the reflection patch as a determination criterion, thereby realizing disconnection detection with a higher reliability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

One embodiment of the present invention will be described with reference to the accompanying drawings.

Figure 2:
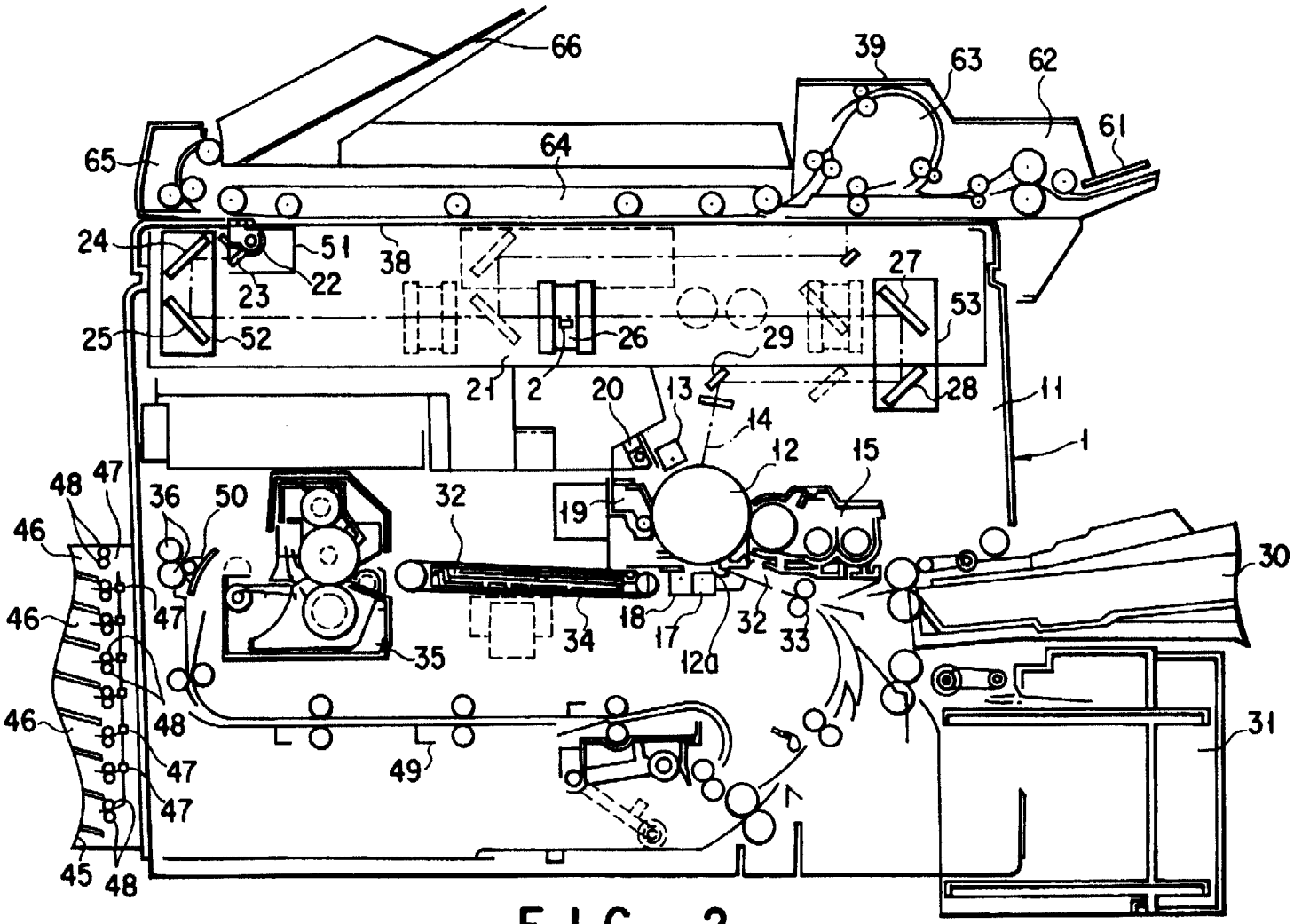
FIG. 2 is a sectional view showing the internal structure of the copying machine serving as the image forming apparatus according to the present invention.

FIG. 2 shows the internal structure of a copying machine 1 serving as an image forming apparatus according to the present invention. A photosensitive drum 12 is rotatably arranged at almost the center in a main body 11 of the copying machine 1. A charger 13, an exposure unit 14, a developing unit 15, a transfer charger 17, a separation charger 18, a cleaner 19, and a charge remover 20 are sequentially arranged around the photosensitive drum 12 along the rotational direction of the photosensitive drum 12.

An original table (original glass) 38 is arranged on the upper surface of the main body 11, and an automatic document (original) feeder 39 is arranged on the original table 38.

A scanner 21 is arranged in the upper portion of the main body 11. The scanner 21 comprises an exposure lamp 22, first to third reflecting mirrors 23, 24, and 25, a magnification lens block 26, and fourth to sixth reflecting mirrors 27, 28, and 29. An auto exposure sensor (AES) 2 serving as a detecting means is arranged aside the magnification lens block 26. The auto exposure sensor 2 detects light exposed on the original with the exposure lamp and reflected by the original and detects the density of the original in accordance with the magnitude Of the light amount.

The original scanning portion (scanning means) of the scanner 21 comprises a first carriage 51 having the exposure lamp 22 for illuminating the original and the first reflecting mirror 23 for reflecting illumination light emitted from the exposure lamp 22 and reflected by the original, and a second carriage 52 having the second and third reflecting mirrors 24 and 25 for further reflecting the light reflected by the original and then the first carriage 51.

The first carriage 51 is disposed to be movable parallel to the original table 38 by a scanner motor 6 through a toothed belt (not shown) or the like.

The second carriage 52 is arranged to be movable through the toothed belt (not shown) for driving the first carriage 51. The second carriage 52 is driven by the first carriage 51 and moves at a speed ½ that of the first carriage 51.

The magnification lens block 26 is arranged below the first carriage 51 within the plane including the optical path of the reflected light returned through the second carriage 52. The magnification lens block 26 is movable through a drive mechanism (not shown), converges the reflected light from the second carriage 52, and moves to focus the reflected light at a desired magnification factor.

In order to correct a change in focal length upon movement of the magnification lens block 26, the reflected light converged by the magnification lens block 26 is guided to the photosensitive drum 12 through a third carriage 53 and the sixth reflecting mirror 29. The third carriage 53 has the fourth and fifth reflecting mirrors 27 and 28 movable along the optical axis by means of a drive mechanism (not shown) to reflect the above convergent light.

The reflected light represents a character or graphic pattern described on the original, i.e., image information on the original, as a matter of course.

A paper cassette 30 and a large-capacity cassette 31 capable of storing 1,000 or more sheets are arranged on one side portion of the main body 11.

A sheet P (image formation medium) fed from the paper cassette 30 or the large-capacity cassette 31 is fed along a paper convey path 32.

A register roller 33, the transfer and separation chargers 17 and 18, a conveyer belt 34, a fixing unit 35, and a delivery roller pair 36 are sequentially arranged in the paper convey path 32 along the convey direction of the sheet P.

A sorter 45 is arranged in the delivery portion of the main body 11. This sorter 45 has a plurality of bins 46, . . . vertically stacked at predetermined intervals, gate means 47, . . . for sorting the sheets P from the delivery roller pair 36, and convey rollers 48, . . . for conveying the sorted sheets P into the corresponding bins 46.

A gate means 50 for switching the path of the sheet P to the outside of the main body 11 or to a reversal paper feed portion 49 is arranged near the delivery roller pair 36. The sheet guided to the reversal paper feed portion 49 is turned over and then fed again along the paper convey path 32.

In a normal copy mode, an original O placed on the original table 38 is scanned with light from the original scanning portion (first and second carriages 51 and 52) of the scanner 21. Light reflected by the original O is focused on the photosensitive drum 12 whose surface is charged by the charger 13, thereby forming an electrostatic latent image. This electrostatic latent image is visualized by supplying a developing agent from the developing unit 15. At this time, the sheet P is fed from the paper cassette 30 or the large-capacity cassette 31. The sheet P is fed to an image transfer portion 12*a* between the photosensitive drum 12 and the transfer charger 17 to transfer the visible image from the photosensitive drum 12 to the sheet P. The image-transferred sheet P is separated from the photosensitive drum 12 by the behavior of the separation charger 18. The sheet P is then fed to the fixing unit 35, and the image is fixed. The image-fixed sheet P is delivered through the delivery roller pair 36 and placed on the uppermost bin 36 through the corresponding gate means 47 of the sorter 45.

A plurality of copies from the original O are selectively sorted on the bins 46, . . . by the gate means 47, etc.

To obtain a two-side copy, the gate means 50 is switched to the reversal paper feed portion 49 to guide the sheet P to the reversal paper feed portion 49. The sheet P is then turned over by the reversal paper feed portion 49 and fed again along the paper convey path 32, and an image is transferred and fixed to the rear surface side. The two-side copy is then delivered.

The automatic document feeder 39 comprises an original feed table 61, a one-sheet pickup portion 62, a reversal portion 63, a convey portion 64, a delivery portion 65, and a delivery tray 66.

A plurality of originals O, . . . to be fed are placed on the original feed table 61. The one-sheet pickup portion 62 picks up the originals O one by one from the original feed table 61 and conveys the picked sheet. The reversal portion 63 directly guides the original O from the one-sheet pickup portion 62 or reverses the original O from the convey portion 64 and sends it back to the convey portion 64. The convey portion 64 conveys the original O from the reversal portion 63 to set it at the reference position of the original table 38 or conveys the original O on the original table 38 to the reversal portion 63 or the delivery portion 65. The delivery portion 65 delivers the original O from the convey portion 64 onto the delivery tray 66.

A control panel 70 for inputting various copy conditions and a copy start signal for starting a copy operation is arranged on the upper front surface portion of the main body 11.

Figure 3:
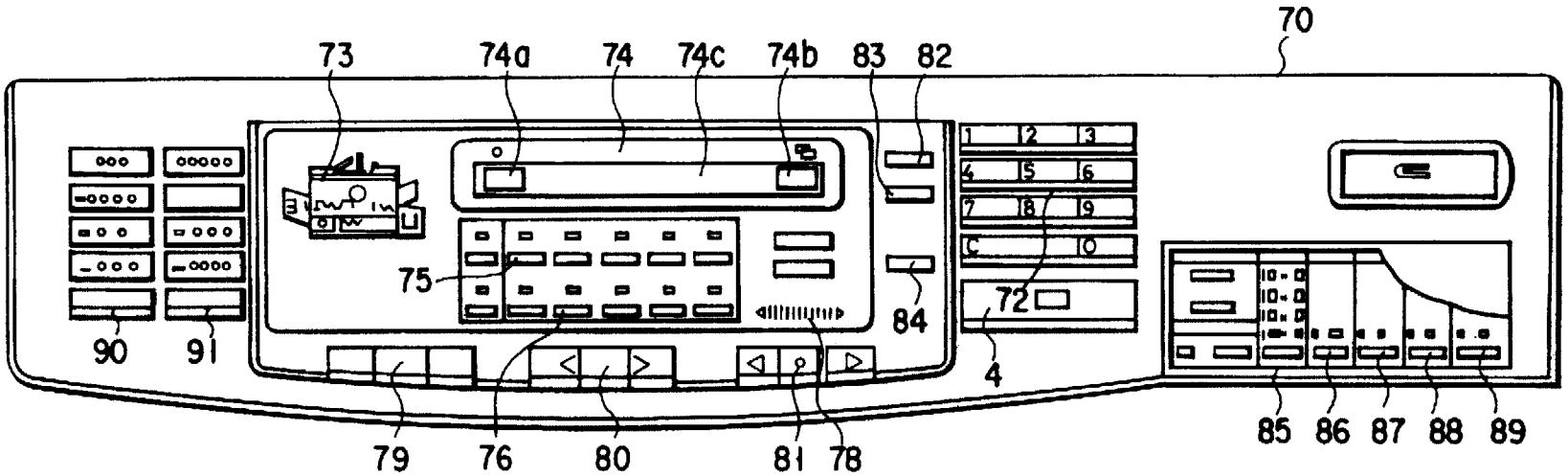
FIG. 3 is a view showing the arrangement of a control panel.

FIG. 3 shows the control panel 70 constituted by a print key 4, a ten-key pad 72, a state display unit 73, a display unit 74, an original size setting button 75, a paper size setting button 76, a density display unit 78, an area setting button 79, a magnification setting button 80, a density setting button 81, an original count setting button 82, a copy count setting button 83, a clear button 84, an edit setting button 85, a bind margin setting button 86, a header page mode setting button 87, a frame erasure setting button 88, a continuous page copy setting button 89, a sort mode setting button 90, and an original feed mode setting button 91.

The print key 4 designates the start of copy.

The ten-key pad 72 sets the original count or copy count.

The state display unit 73 displays the state of selection of a paper cassette and gives guidance messages for original and paper jam, and paper replenishment.

The display unit 74 comprises an original count display section 74*a*, a copy count display section 74*b*, and a guidance display section 74*c* to display the original and copy counts, the copy magnification factor, and gives guidance messages for various operations.

The original size setting button 75 sets the size of the original O.

The paper size setting button 76 sets the size of the sheet P.

The density display unit 78 displays the copy density set by the density setting button 81.

The magnification setting button 80 sets the copy magnification factor.

The density setting button 81 sets the copy density. The original count setting button 82 is used to set the number of originals O placed on the original feed table 61 at the start of copying. By setting the original count setting mode with this button, an original count input by the ten-key pad 72 is displayed on the original count display section 74*b* of the display unit 74.

The copy count setting button 83 is used to set the number of copies at the start of copying. By setting the copy count setting mode with this button, a copy count input by the ten-key pad 72 is displayed on the copy count display section 74*b* of the display unit 74.

The clear button 84 is used to clear the set contents of the respective buttons and restore the initial state.

The edit setting button 85 sets copy modes for copying one-side images of the originals O on two sides of the sheet P, copying two-side images of the original O on the two sides of the sheet P, and copying two-side images of the original on one-side surfaces of the sheets P, and also sets a book copy mode.

Figure 4:
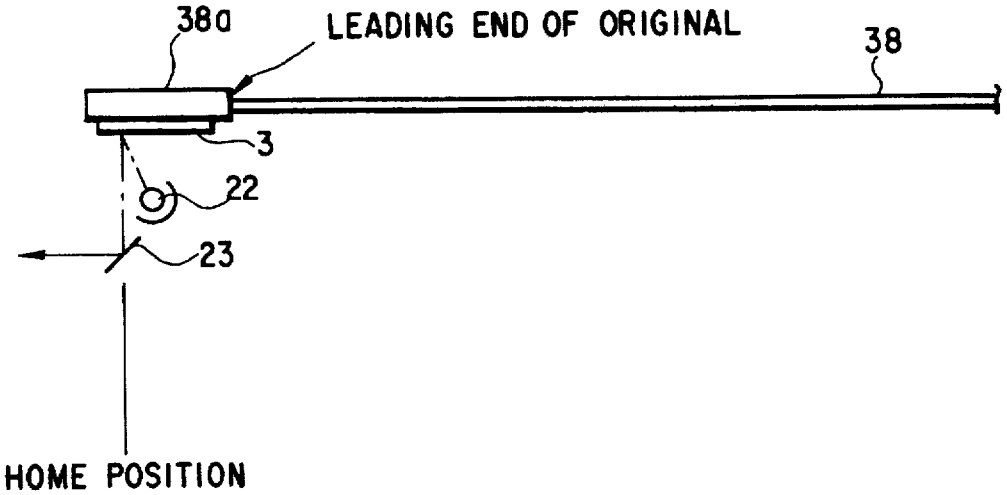
FIG. 4 is a view showing a detection portion for detecting a disconnection of an exposure lamp at a position except for an original.

FIG. 4 shows a detection portion for detecting a disconnection of the exposure lamp 22 at a position except for the original. A patch (a patch having a reflectance of 50% as a reference reflection means in this embodiment) 3 is arranged on the lower surface of an indicator 38*a* located aside the original table 38 and representing a copy enable range. The patch 3 is exposed prior to original scanning, and the light amount is detected by the auto exposure sensor 2.

Figure 1:
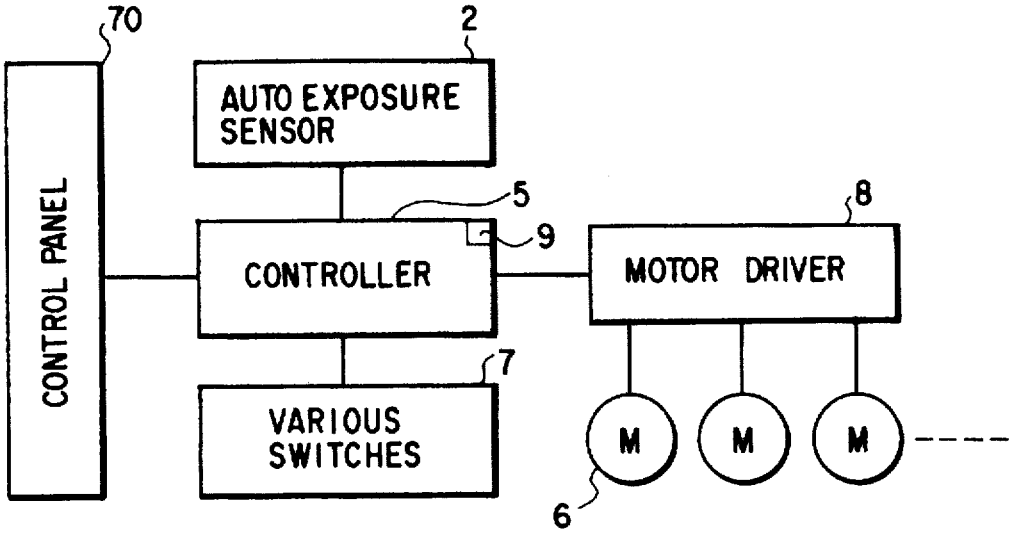
FIG. 1 is a block diagram showing the schematic arrangement of a control circuit in a copying machine according to an image forming apparatus of the present invention.

FIG. 1 shows the schematic arrangement of the control circuit of the copying machine 1. The control circuit comprises a controller 5 constituted by a microcomputer to control the overall operation of the copying machine 1, switches 7, a motor driver 8 for driving various motors including the scanner motor 6, the auto exposure sensor 2, and the control panel 70.

The controller 5 stores the average value of data output from the auto exposure sensor 2 in a memory 9 serving as a storage means arranged inside the controller 5. The controller 5 detects operating states from the various switches 7, and transmits signals to the motor driver 8 to drive various motors including the scanner motor 6. A copy count, exposure conditions, and the like are set on the control panel 70 and transmitted to the controller 5.

Figure 5:
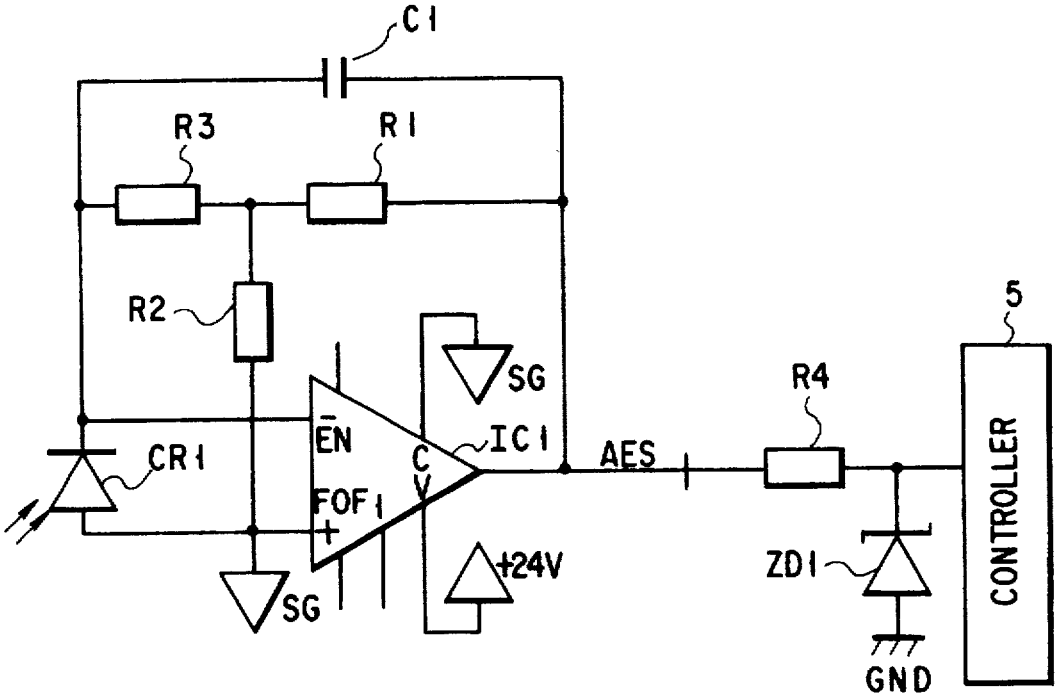
FIG. 5 is a view showing the circuit arrangement for an auto exposure sensor.

FIG. 5 shows the arrangement of a circuit for the auto exposure sensor 2. The circuit includes a photodiode CR1, a capacitor C1, resistors R1 to R4, an amplifier IC1, and a Zener diode ZD1. A current changes with an increase/decrease in amount of light incident on the photodiode CR1. The current is converted into a voltage by the amplifier IC1, and the voltage is output to the controller 5.

Figure 6A:
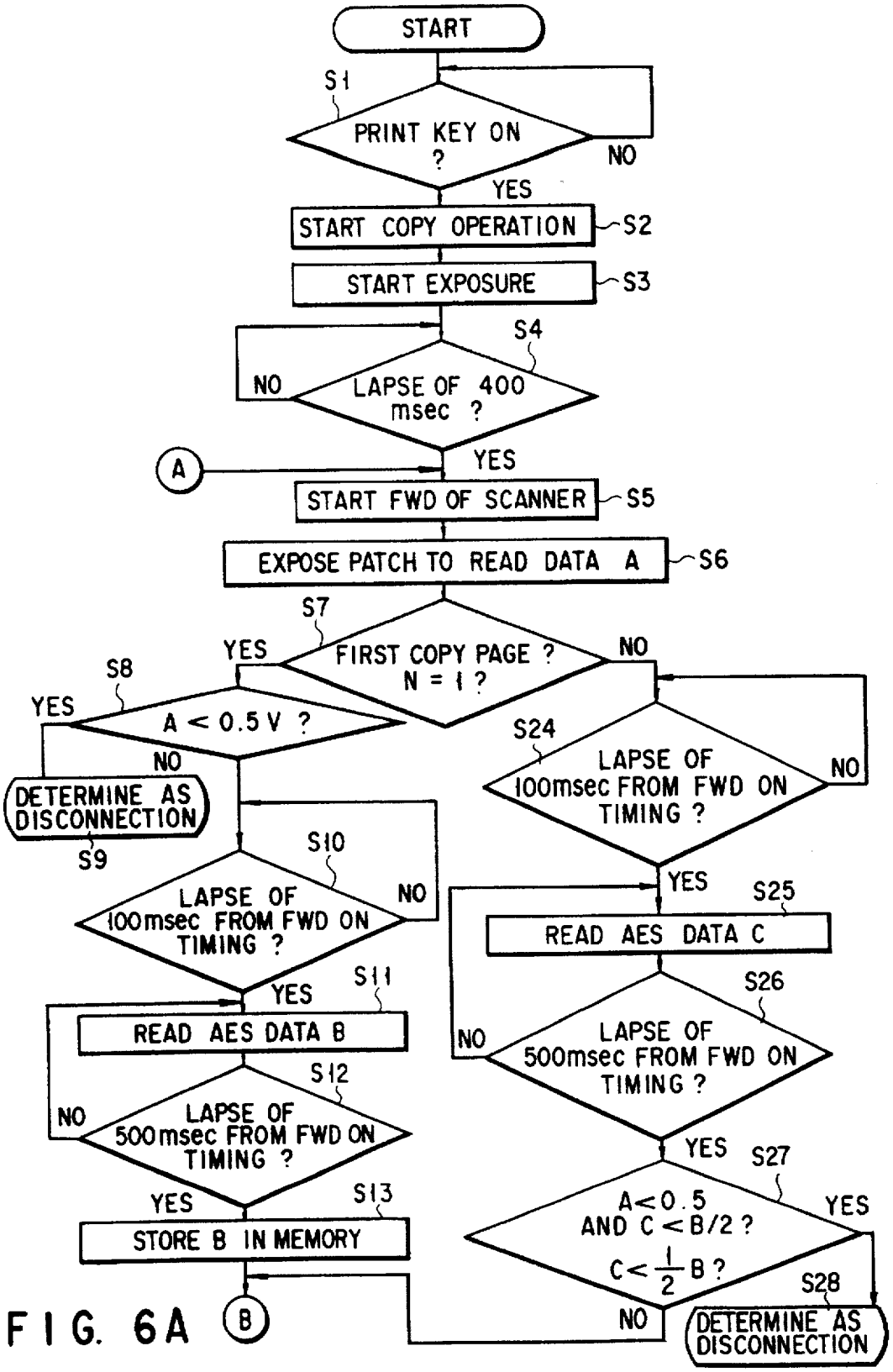
FIGS. 6A and 6B are flow charts for explaining a disconnection detection operation for the exposure lamp.
Figure 6B:
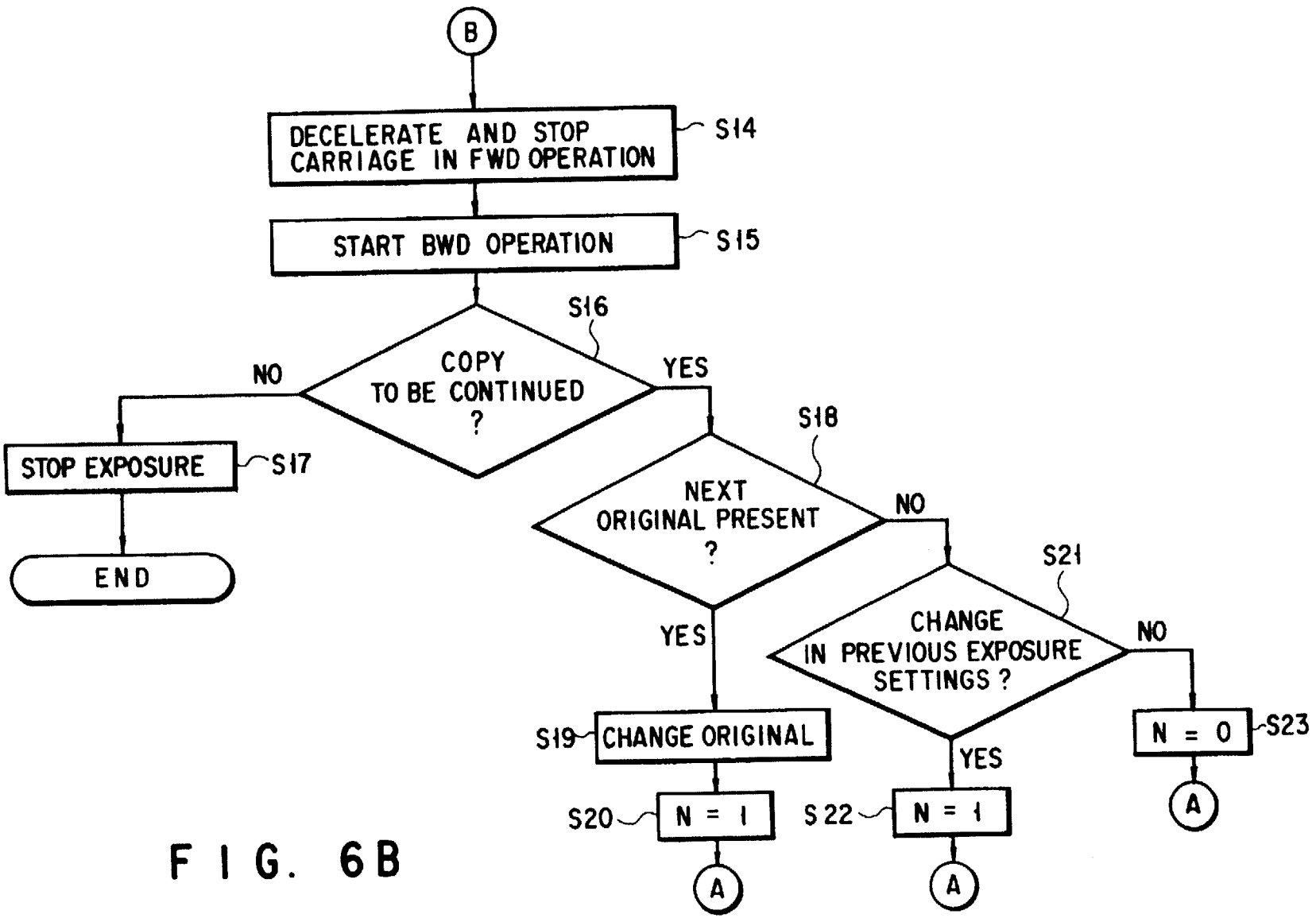

The operation of disconnection detection of the exposure lamp 22 in the copy mode in this arrangement will be described with reference to the flow chart in FIGS. 6A and 6B.

When the print key 4 on the control panel 70 is turned on (S1), a copy operation is started (S2) under the control of the controller 5, and the exposure lamp 22 is turned on (S3).

When a period of 400 msec has elapsed upon turn-on operation of the exposure lamp 22 (S4), an FWD ON signal for the scanner motor 6 is transmitted from the controller 5 to the motor driver 8, and the original scanning portion (first and second carriages 51 and 52) of the scanner 21 starts a FWD (forward) operation (S5). At this time, the patch 3 having a reflectance of 50% is exposed to read light amount data in the controller 5 through the auto exposure sensor 2 (S6). This value is sampled in synchronism with each zero-crossing timing (10-msec interval at 50 Hz). The average value of four data from the FWD ON timing is stored as "A" in the memory 9.

The controller 5 determines whether the first page is to be copied (S7). If YES in step S7, the value "A" is compared with a preset value (0.5 V in this embodiment) (S8). If A<0.5, then the controller 5 determines that disconnection of the exposure lamp 22 has occurred, thereby interrupting the copy operation (S9). If A r 0.5, then the controller 5 determines that disconnection of the exposure lamp 22 has not occurred, thereby continuing the copy operation.

When a period of 100 msec has elapsed, i.e., when the first carriage 51 of the scanner 21 has reached the leading end of the original from the FWD ON timing (S10), the controller 5 starts to read the outputs from the auto exposure sensor (AES) 2 again (S11). The outputs from the auto exposure sensor 2 are continuously read until a period of 500 msec has elapsed, i.e., until the first carriage 51 of the scanner 21 reaches the trailing end of the original from the FWD ON timing (S12). This data is also sampled every 10 msec, and an average value "B" of 41 data (400-msec components) is stored in the memory 9 in the controller 5 (S13).

The controller 5 then transmits a deceleration or stop signal for the original scanning portion of the scanner 21 to the motor driver 8. The original scanning portion of the scanner 21 is decelerated or stopped. After the controller 5 stops for a predetermined period of time (30 msec) and transmits acceleration, constant-speed, deceleration, and stop signals for a BWD (backward) operation to the motor driver 8. A BWD operation of the original scanning portion of the scanner 21 is performed (S15).

When the BWD operation is completed, the controller 5 determines whether the copy operation is to be ended or continued (S16). If the copy operation is to be ended, the exposure map 22 is turned off (S17), thereby ending the copy operation.

If the copy operation is to be continued, the controller 5 determines whether the original should be changed by the automatic document feeder 39 (S18). If YES in step S18, the original is changed by the automatic document feeder 39 (S19), and N=1 (S20) is set. Another FWD operation of the scanner is then started (S5), and data "A" is read and stored in the memory 9. Since N=1 in step S7, the same operations as in steps S8 to S16 are performed.

If the controller 5 determines in step S18 that the original need not be changed, the controller 5 checks the presence/absence of a change in exposure settings in the previous copy operation (S21). If YES in step S21, N=1 (S22) is set; otherwise, N=0 (S23) is set, and a FWD operation of the original scanning portion of the scanner 21 is started (S5). Data "A" is read and stored in the memory 9 again. Since N=1 is determined in step S7, the operations in steps S8 to S16 are performed as in the above case.

If no original is present, and N=0 is set, the controller 5 performs the following operation. Since the copy is not the first copy page for the same original in step S7, the controller 5 starts to read outputs from the auto exposure sensor 2 again 100 msec (S24) after the FWD ON timing of the original scanning portion of the scanner 21 (S25). The controller 5 continuously reads the outputs from the auto exposure sensor 2 until a period of 500 msec has elapsed (S26). This data is also sampled every 10 msec. An average value "C" of 41 data is stored in the memory 9 independently of the value "B".

When write access of "C" to the memory 9 is completed, the controller 5 determines whether A<0.5 V and C<B/2 (S27). If YES in step S27, the controller determines that disconnection of the exposure lamp 22 has occurred (S28). If NO in step S27, the controller 5 determines that disconnection of the exposure lamp 22 has not occurred, and the copy operation continues to the end in the same manner as described above.

The values "B" and "C" should satisfy condition B=C because they are the outputs from the auto exposure sensor 2 for the same original at the same exposure conditions.

Figure 7A:
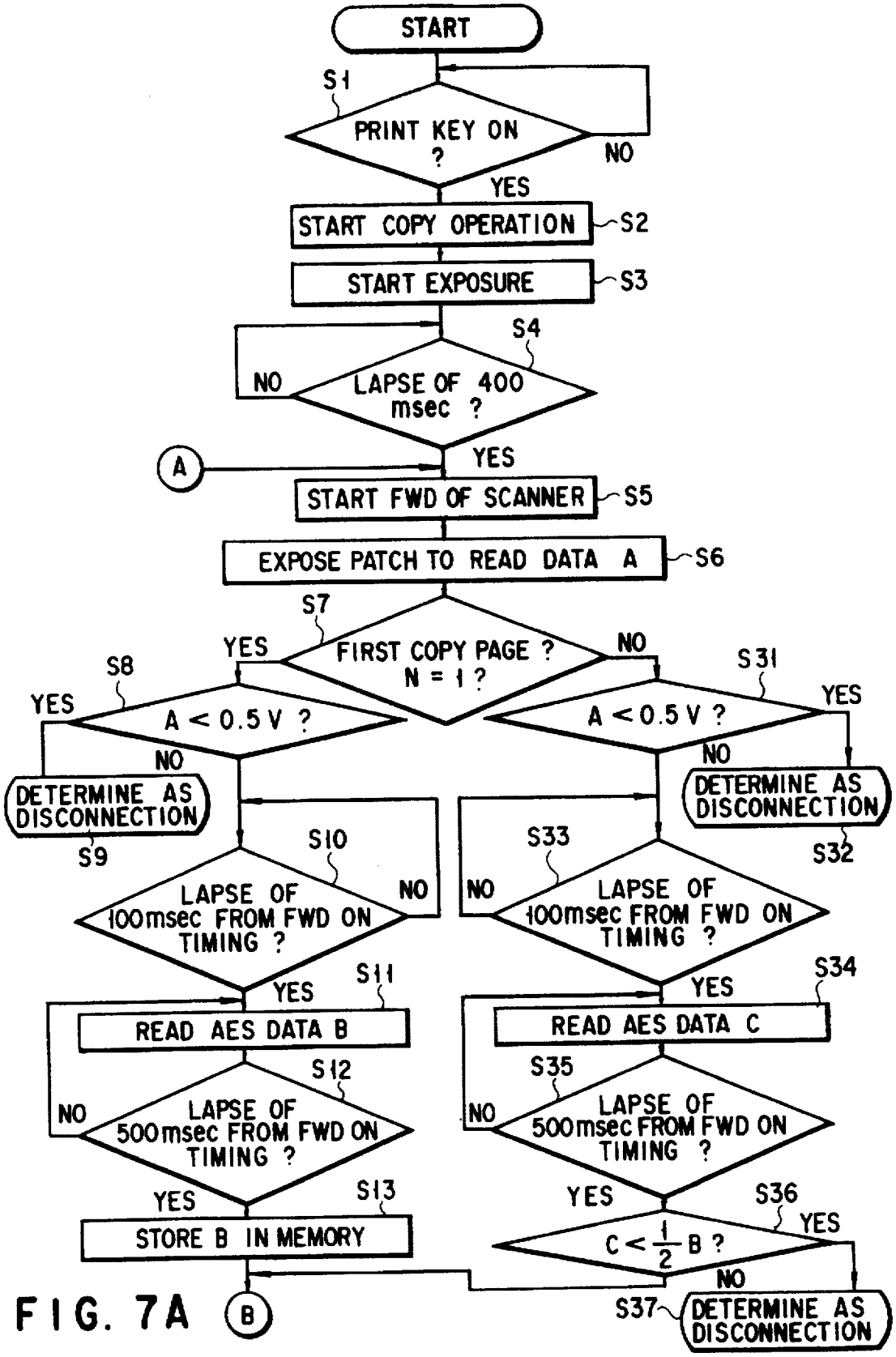
FIGS. 7A and 7B are flow charts showing explaining the disconnection detection operation for the exposure lamp.
Figure 7B:
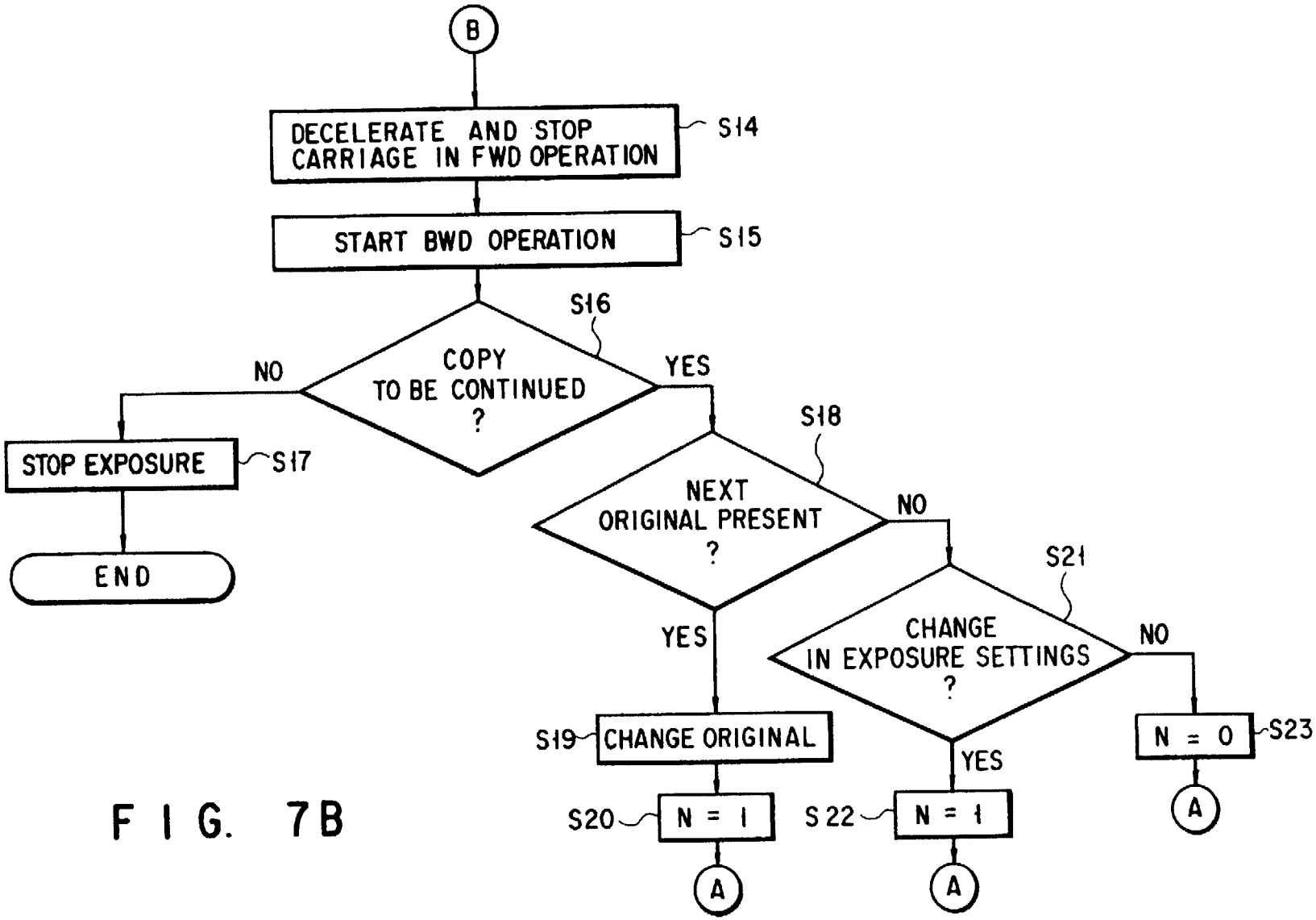

Disconnection detection of the exposure lamp 22 for a copy which is not the first copy page for the same original (N=0), as shown in FIGS. 7A and 7B, may be determined in two independent steps as follows. Whether disconnection of the exposure lamp 22 has occurred is determined after the value "A" is read as in the first copy page (S31). If disconnection is not determined, the data "C" representing the density of the original is read (S33 to S35) to determine whether C<B/2 is established (S36).

Figure 8:
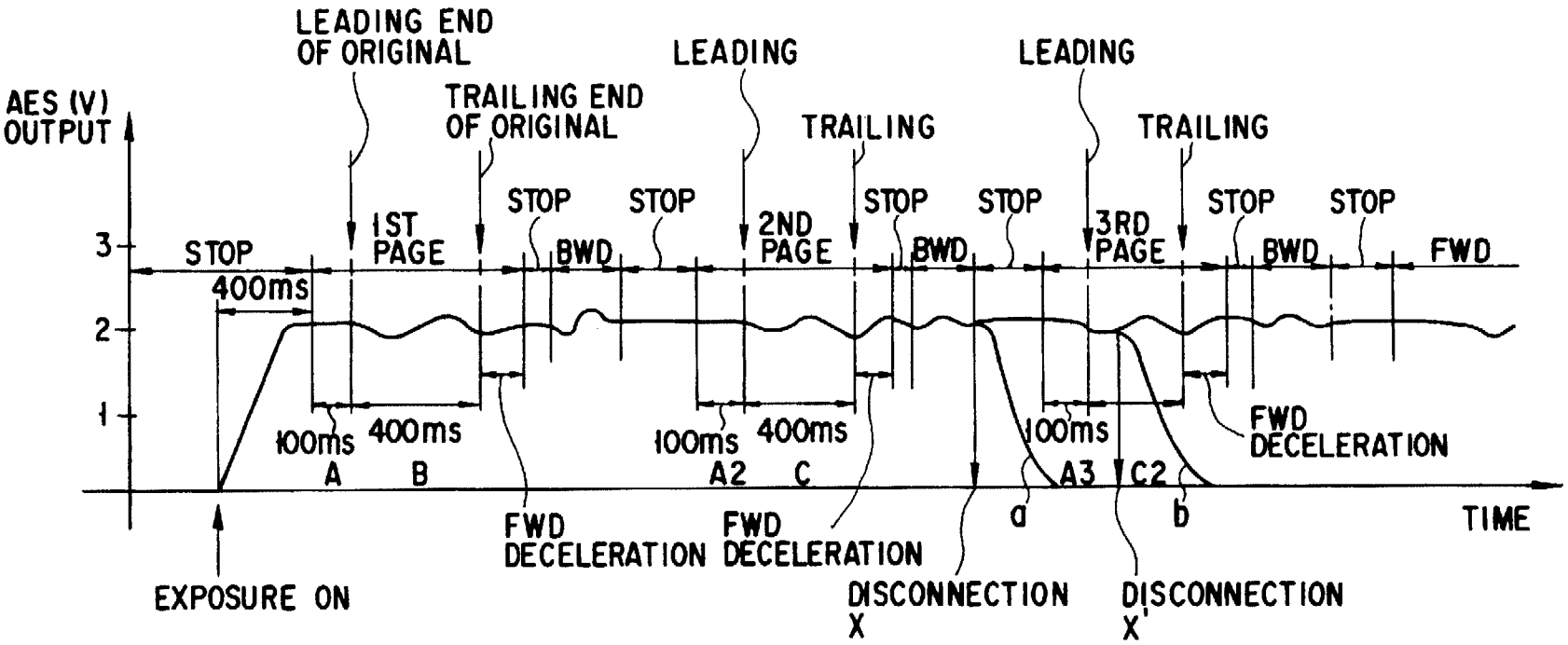
FIG. 8 is a timing chart showing an output from the auto exposure sensor.
Figure 9:
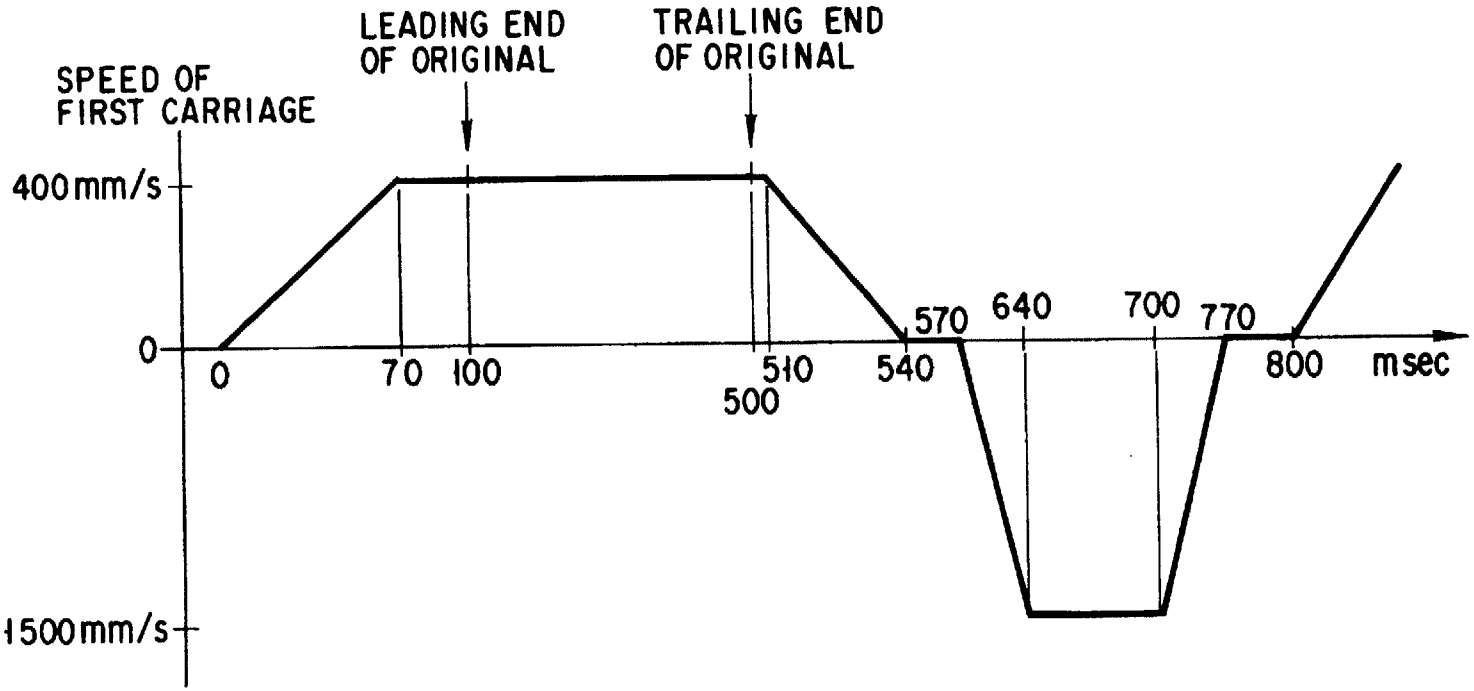
FIG. 9 is a timing chart showing the operation of the first carriage of a scanner.

FIG. 8 shows the timing chart of outputs from the auto exposure sensor 2. FIG. 9 shows the timing chart of an operation in the first carriage 51 of the scanner 21.

Referring to FIG. 8, the exposure lamp 22 is turned on upon depression (ON) of the print key 4 to raise the output from the auto exposure sensor (AES) 2 to 2.0 V together with the rise of the exposure lamp 22. This takes about 400 msec.

Upon the FWD ON operation, the first carriage 51 of the scanner 21 is accelerated over 70 msec, as shown in FIG. 9, and reaches the leading end of the original in 100 msec. During this period, the patch 3 is exposed to fetch data "A".

The first carriage 51 of the scanner 21 then moves at a constant speed (400 mm/s) to fetch data "B" or "C". The output waveform of the auto exposure sensor 2 during this period changes in accordance with changes in original densities, as shown in FIG. 8.

The first carriage 51 of the scanner 21 moves at a constant speed for 10 msec, and is decelerated to stop. After stopping for 30 msec (570 msec from the FWD ON timing), a BWD operation is performed to accelerate the first carriage 51 over 70 msec to a speed of 1,500 mm/s. The carriage 51 then moves at a constant speed for 60 msec and is decelerated over 70 msec, thereby ending the BWD operation. If the next copy operation is required, the above operations are repeated with a lapse of 30 msec.

An operation upon occurrence of disconnection of the exposure lamp 22 will be described below.

When disconnection occurs at a timing "X" in FIG. 8 (when disconnection is caused by vibrations immediately after the stop upon completion of the BWD operation for the second copy page), the output from the auto exposure sensor 2 decreases, as indicated by a solid line a in FIG. 8. A FWD operation for the third copy page is started, and the output "A" (="A3") from the auto exposure sensor 2 becomes almost 0 V, which is lower than 0.5 V, thereby determining disconnection. This determination is represented by steps S31 and S32 in the flow chart of FIGS. 7A and 7B. Also in the flow chart of FIGS. 6A and 6B, the data "C" becomes 0 V, and conditions A2<0.5 V and C2=0<B/2 (B=2.0), thereby determining disconnection (S27 and S28).

When disconnection occurs at a timing "X2" (during original exposure for the third copy page), the output from the auto exposure sensor 2 decreases, as indicated by a solid line b. In FIGS. 7A and 7B, if C2<B/2 is determined (this condition changes depending on the type (density) of original and the timing), disconnection is determined (S36 and S37). Even if the case in FIGS. 6A and 6B or C2 r B/2 is satisfied, conditions A=0 and C=0 are satisfied for the fourth copy page, as described above, thereby determining disconnection.

If the exposure settings are changed for the same original during a copy operation, the output from the auto exposure sensor 2 also changes. When the exposure settings are changed, the first copy page obtained upon the change is used as a new comparison reference.

According to this embodiment, as has been described above, using the fact that identical output waveforms of the auto exposure sensor can be obtained for the same original, the auto exposure sensor output for the first copy page is compared with the auto exposure sensor output for the second or subsequent copy page for the same original to perform double checking including the conventional check scheme, thereby improving reliability in exposure lamp disconnection detection.

In addition to the above case, for example, if the amount of light reflected by the patch is low, or if an trouble is detected in only the reflected light beams B, C, . . . of the originals, disconnection may be determined.

Reliable disconnection detection can be performed in the same manner as described above without departing from the spirit and scope of the invention.

According to the present invention, as has been described above, there can be provided an image forming apparatus capable of improving reliability of exposure lamp disconnection detection.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An exposing apparatus comprising:

means for exposing an original placed on an original table with a light and scanning the original;

means, arranged in a vicinity of the exposing means, for reflecting the light from the exposing means so as to generate a first reflected light;

means for detecting the first reflected light from the reflecting means and a second reflected light from the original on the original table;

means for setting the exposing means so that the exposing/scanning of one original is repeated a plurality of times;

first calculating means for calculating a first amount of the first reflected light for each time of exposing/scanning the one original and for storing each of the first amounts as reference data;

second calculating means for calculating a second amount of the second reflected light for each time of exposing/scanning the one original; and means for determining a malfunction of the exposing means trouble by comparing the first amount with the second amount.

2. An exposing apparatus according to claim 1, wherein the first calculating means includes means for sampling the first amount at each time and calculating an average value of the sampling.

3. An exposing apparatus according to claim 1, wherein the determining means includes means for comparing the first amount for a current set of exposing/scanning times with the first amount for a prior set of exposing/scanning times; and means for comparing the second amount with a reference value, the second amount being calculated by the second calculating means for each exposing/scanning time.

4. An exposing apparatus according to claim 3, wherein the determining means determines the malfunction of the exposing means when a first difference between the first amount of the current set and the first amount of the prior set is larger than a first predetermined value and when a second difference between the second amount and a reference value is larger than a second predetermined value based on comparisons of the first and second comparing means.

5. An exposing apparatus comprising:

means for exposing an original with a light and scanning the original;

means, arranged in a vicinity of the exposing means, for detecting a reflected light from the original;

means for setting the exposing means so that the exposing/scanning of the original is repeated a plurality of times;

means for calculating an amount of the reflected light detected by the detecting means for each of the exposing/scanning times; and means for determining a malfunction of the exposing means by referring to the amount calculated by the calculating means.

6. An exposing apparatus according to claim 5, wherein the calculating means includes means for sampling the amount for each exposing/scanning time and calculating an average value of the sampling.

7. An exposing apparatus according to claim 5, wherein the determining means includes means for comparing the amount for a current set of exposing/scanning times with the amount for a prior set of exposing/scanning times.

8. An exposing apparatus according to claim 7, wherein the determining means determines the malfunction of the exposing means, when a difference between the amount of a current set of exposing/scanning times and the amount of a prior set of exposing/scanning times is larger than a predetermined value based on a comparison of the comparing means.

9. A method of detecting malfunction of an exposing apparatus, comprising:

exposing step for exposing an original placed on an document table and scanning the original;

detecting step for detecting a first light reflected by a reflection function and detecting a second light reflected by the original;

setting step for setting a plurality of times for exposing/scanning the original;

first step for calculating a first amount of the first light for each one of the plurality of exposing/scanning times and storing the first amount as reference data;

second step for calculating a second amount of the second light for each one of the plurality of exposing/scanning times; and determining step of determining a malfunction of the exposing step by comparing the first amount with the second amount.

10. A method according to claim 9, wherein the first calculating step includes step for sampling the first amount at each of the plurality of times and calculating an average value of the sampling.

11. A method according to claim 9, wherein the determining step includes the step of comparing the first amount for a current set of exposing/scanning times with the first amount for a prior set of exposing/scanning times; and comparing step of comparing the second amount with a reference value, the second amount being calculated by the second calculating step for each of the plurality of exposing/scanning times.

12. A method according to claim 11, wherein the determining step determines the malfunction of the exposing step, when a first difference between the first amount of a current set of times and the first amount of a prior set of times is larger than a first predetermined value and when a second difference between the second amount and a reference value is larger than a second predetermined value based on comparisons of the first and second comparing step.

13. A method of detecting malfunction of an exposing apparatus comprising:

exposing step for exposing an original placed on an document table and scanning the original;

detecting step for detecting a light reflected by a reflection function;

setting step for setting a plurality of exposing/scanning times of the original;

calculating am amount of the light detected by the detecting step for each one of the exposing/scanning times; and determining a malfunction of the exposing step by referring to the amount calculated by the calculating step.

14. A method according to claim 13, wherein the calculating step includes a step for sampling the amount at each exposing/scanning time and calculating an average value of the sampling.

15. A method according to claim 13, wherein the determining step includes a step for comparing the amount for a current exposing/scanning time with the amount for a prior exposing/scanning time.

16. A method according to claim 15, wherein the determining step determines the malfunction of the exposing step, when a difference between the amount for a current exposing/scanning time and the amount for a prior exposing/scanning time is larger than a predetermined value based on a comparison of the comparing step.

17. An exposing apparatus comprising:

means for exposing an original with a light and scanning the original;

means arranged in a vicinity of the exposing means for detecting a reflected light from the original;

means for setting the exposing means so that the exposing/scanning of the original is repeated a plurality of times;

means for calculating an amount of the reflected light for each exposing/scanning time;

means for storing the amount of the reflected light at a first time scanning of the original as a reference value;

means for comparing the amount calculated by the calculating means at a second time scanning of the original with the reference value stored by the storing means; and means for determining a malfunction of the exposing means each exposing/scanning time corresponding to the comparison result of the comparing means.

18. An exposing apparatus comprising:

means for automatically feeding an original table;

means for exposing the original with a light and scanning the original;

means arranged in a vicinity of the exposing means for detecting a reflected light from the original;

means for setting the exposing means so that the exposing/scanning of the original is repeated a plurality of times;

means for calculating an amount of the reflected light for each exposing/scanning time respectively;

means for storing the amount of the reflected light at a first time scanning of the original as a reference value;

means for comparing the amount calculated by the calculating means at a second time scanning of the original with the reference value stored by the storing means; and means for determining a malfunction of the exposing means for each exposing/scanning time corresponding to the comparison result of the comparing means.

* * * * *